US006837792B2

(12) United States Patent
Cranford

(10) Patent No.: US 6,837,792 B2
(45) Date of Patent: Jan. 4, 2005

(54) AUTOMATIC DISCARD RACK

(76) Inventor: Tony A. Cranford, 12252 W. Chenango Dr., Morrison, CO (US) 80465

( * ) Notice: Subject to any disclaimer, the term of this patent is extended or adjusted under 35 U.S.C. 154(b) by 407 days.

(21) Appl. No.: 09/976,363

(22) Filed: Oct. 15, 2001

(65) Prior Publication Data

US 2002/0072419 A1 Jun. 13, 2002

Related U.S. Application Data

(60) Provisional application No. 60/240,168, filed on Oct. 13, 2000.

(51) Int. Cl.[7] ..... A63F 13/00; A63F 9/24; G06F 17/00; G06F 19/00

(52) U.S. Cl. ..... 463/42; 463/47

(58) Field of Search ..... 273/148 R, 309, 273/149 R, 149 P; 270/58.01, 30.01, 30.05; 209/534, 538, 592, 593, 594, 595, 606, 617; 414/796, 796.6, 788.9, 788.1; 463/47

(56) References Cited

U.S. PATENT DOCUMENTS 3,312,473 A * 4/1967 Friedman et al.
3,690,670 A * 9/1972 Cassady et al.
4,310,160 A * 1/1982 Willette et al.
4,497,488 A * 2/1985 Plevyak et al.
4,513,969 A * 4/1985 Samsel, Jr.
4,515,367 A * 5/1985 Howard
4,770,421 A * 9/1988 Hoffman
4,807,884 A * 2/1989 Breeding
5,000,453 A * 3/1991 Stevens et al.
5,261,667 A * 11/1993 Breeding
5,356,145 A * 10/1994 Verschoor
5,431,399 A * 7/1995 Kelley
5,575,475 A * 11/1996 Steinbach
5,676,372 A * 10/1997 Sines et al. ..... 273/149 R
5,695,189 A * 12/1997 Breeding et al. ..... 273/149 R
5,718,427 A * 2/1998 Cranford et al. ..... 273/149 R
5,944,310 A * 8/1999 Johnson et al. ..... 273/149 R
6,149,154 A * 11/2000 Grauzer et al. ..... 273/149 R
6,250,632 B1 * 6/2001 Albrecht ..... 273/149 R

FOREIGN PATENT DOCUMENTS

GB 2265139 A * 9/1993 ..... B65H/1/04

* cited by examiner

*Primary Examiner*—Michael O'Neill
(74) *Attorney, Agent, or Firm*—Arent Fox Kintner Plotkin & Kahn PLLC; Wilburn L. Chesser

(57) ABSTRACT

A device, referred to as the "automatic discard rack" for use on casino gaming tables or elsewhere to hold and mix playing cards, such as cards discarded following each hand of a played game. The device includes features for randomly picking up a portion of cards placed in the rack to allow cards inserted into the rack to be randomly inserted into cards already in the rack, and the cards to be repeatedly mixed by the device. Variations of the device include a housing, clamping portion, a moveable lifting portion for moving the clamping portion, a moving engine for causing the movement, including clamping, of the clamping portion, a controller for controlling all movement, sensor for sensing placement of cards in the device and initiating movement, a "kill switch," and an on/off switch.

20 Claims, 5 Drawing Sheets

AUTOMATIC DISCARD RACK

This application claims priority from U.S. Provisional Patent Application Ser. No. 60/240,168 filed Oct. 13, 2000. The entirety of that provisional application is incorporated herein by reference.

BACKGROUND OF THE INVENTION

1. Field of the Invention

The present invention relates to devices for card mixing, and in particular to an automatic card mixing device for discarded cards dealt from a card shoe.

2. Background of the Technology

Existing methods of dealing of Blackjack and other multideck casino card games provide unscrupulous players with opportunities to take advantage of the house. In standard play in casinos, every card is turned up at the end of play so that players are able to see the cards following the play. The cards are then placed in perfect order in a discard rack. This procedure occurs for each hand. One reason for this approach is to allow the house to back out of a hand.

One problem with these existing approaches is that, upon completion of discard of all of the cards in a shoe, a player or card tracker with a good memory (e.g., a photographic memory) may have a perfect picture of the order of 80% of the cards. If the house fails to make a thorough shuffle, the cards can be tracked.

There remains a need for devices, particularly automated devices, for assuring thorough and random mixing of discarded cards prior to shuffling and continued play with the cards.

SUMMARY OF THE INVENTION

The present invention, referred to as an "automatic discard rack" is usable to assure thorough and random mixing of cards, such as cards discarded during play of casino card games, prior to shuffling and continued play with the cards. The present invention thus automatically increases randomness of the cards for shuffling.

With the present invention, when the dealer inserts, for example, a dead hand into the discard rack, a preset or optionally adjustable delay starts, followed by a clamping portion controlled by a controller and a moving engine within the rack, such as a pair of gripper arms, placing any cards already in the clamping portion onto the pile of cards in the device, and randomly picking up a portion of the discarded cards. The delay allows the dealer to retrieve the cards placed into the device prior to mixing, upon, for example, an error or challenge occurring during the course of play of the card game. The clamping portion holds the cards until the dealer inserts the next hand, and so on for each additional hand. The present invention, which, in one embodiment, is capable of holding up to eight decks of cards, thus randomly mixes the dead hands, reducing the likelihood that trackers are able to track the cards discarded or otherwise placed into the rack following discard. The device is also configurable to handle any number of decks of cards.

In an embodiment of the present invention, the clamping portion operates within or from a housed portion of the rack, the housed portion also including a moveable lifting portion for moving the clamping portion, a moving engine, such as an electric motor or solenoid for causing the movement of the clamping portion, including clamping via, for example, gears, levers, ratcheting devices, arms, and/or other features known in the art, a controller, such as a processor for controlling operation of the clamping portion, a sensor, such as an electric or electronic eye for sensing placement of cards in the device and initiating movement of the clamping portion, and optional other features, such as a "kill switch" and an on/off switch.

The present invention thus allows the casino operator to perform a simple and quick shuffle and to still have confidence in complete protection against cheaters. As a result, casinos potentially make more revenue due to the increased number of hands that may be played, owing to the reduced shuffle time, while reducing the likelihood of lost revenue due to card counting or tracking.

Additional advantages and novel features of the invention set forth in part in the description that follows, considered in conjunction with the accompanying drawing figures, will become more apparent to those skilled in the art upon examination of the following or upon learning by practice of the invention. It is to be understood, however, that the drawings are designed solely for the purposes of illustration and not as a definition of the limits of the invention.

DETAILED DESCRIPTION

The present invention is a device for automatically mixing cards placed into the device, including, for example, cards discarded in the course of standard play of a card game, such as a card game at a casino, prior to the cards being shuffled for use in additional play.

References will now be made in detail to embodiments of the present invention, examples of which are illustrated in the accompanying drawings.

Figure 1:
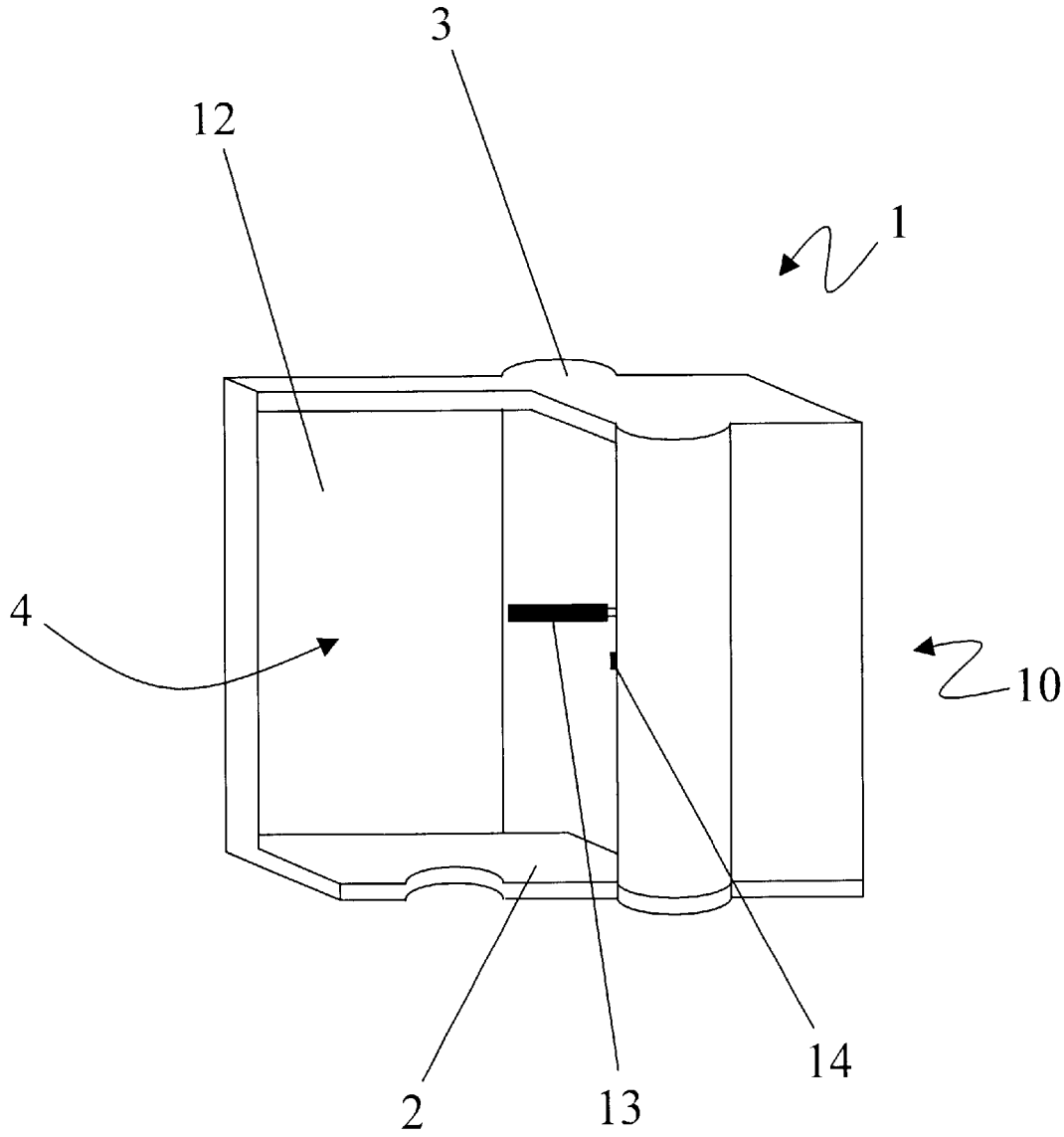
FIG. 1 presents a perspective view of an automatic discard holder, in accordance with one embodiment of the present invention.
Figure 2:
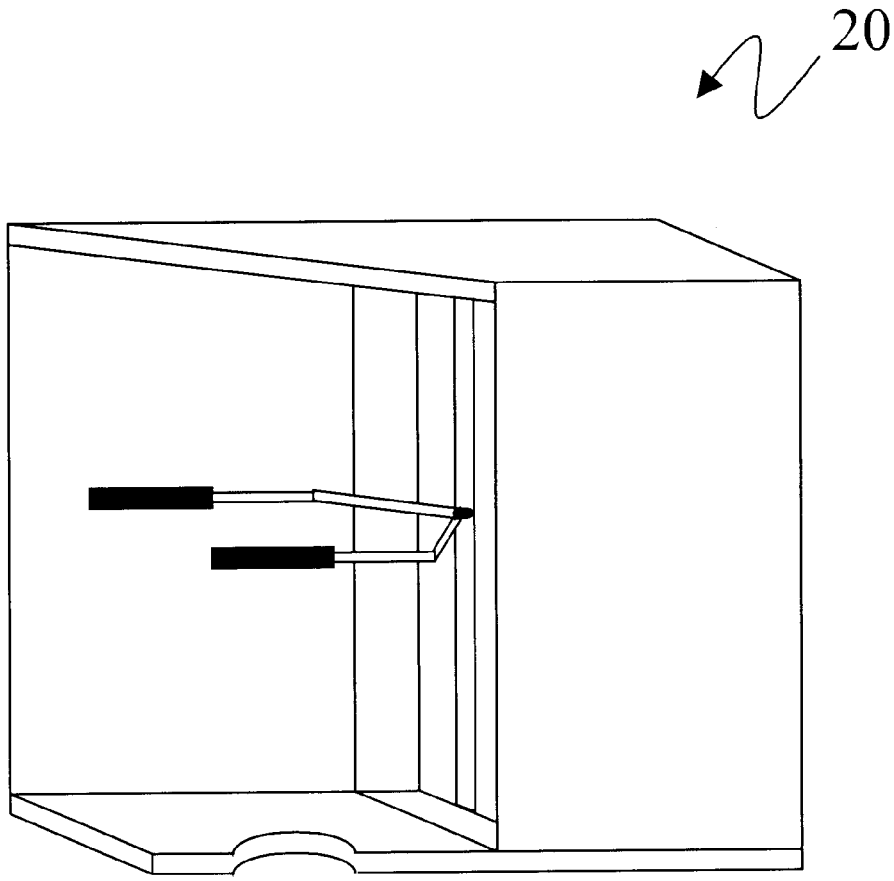
FIG. 2 shows a second example layout and design for an automatic discard holder, in accordance with an embodiment of the present invention.

FIG. 1 presents a perspective view of an automatic discard holder, in accordance with one embodiment of the present invention. As shown in FIG. 1, the holder 1, includes a base 2, such as a plastic or other material bottom, a top cover 3, and an opening 4 for receiving cards into the holder 1. The opening 4 allows observers, such as card game players, to view the mixing of the cards by the holder 1. The holder 1 also includes a housing portion 10 and one or more side extensions 12. The arrangement and design of the housing 10, side 12, top 3, and bottom 2 of the rack 1, as shown in FIG. 1, are merely illustrative of one design and layout for the device. As will be obvious to one skilled in the art, many arrangements and designs for the the device are possible without departing from the scope of the invention. A second example layout and design for a rack 20, in accordance with a second embodiment of the present invention, is shown in FIG. 2.

As shown in FIG. 1, in use of the holder 1, in accordance with one embodiment of the present invention, upon, for example, discard of hands in the course of play of a casino game, the discarded cards are placed in a stack on the bottom 2 of the holder 1. As will be described further, following a short delay, a clamping device 13, 14, including, for example, gripper arms, proceeds to move via a moving device housed in the housing 10.

Figure 3:
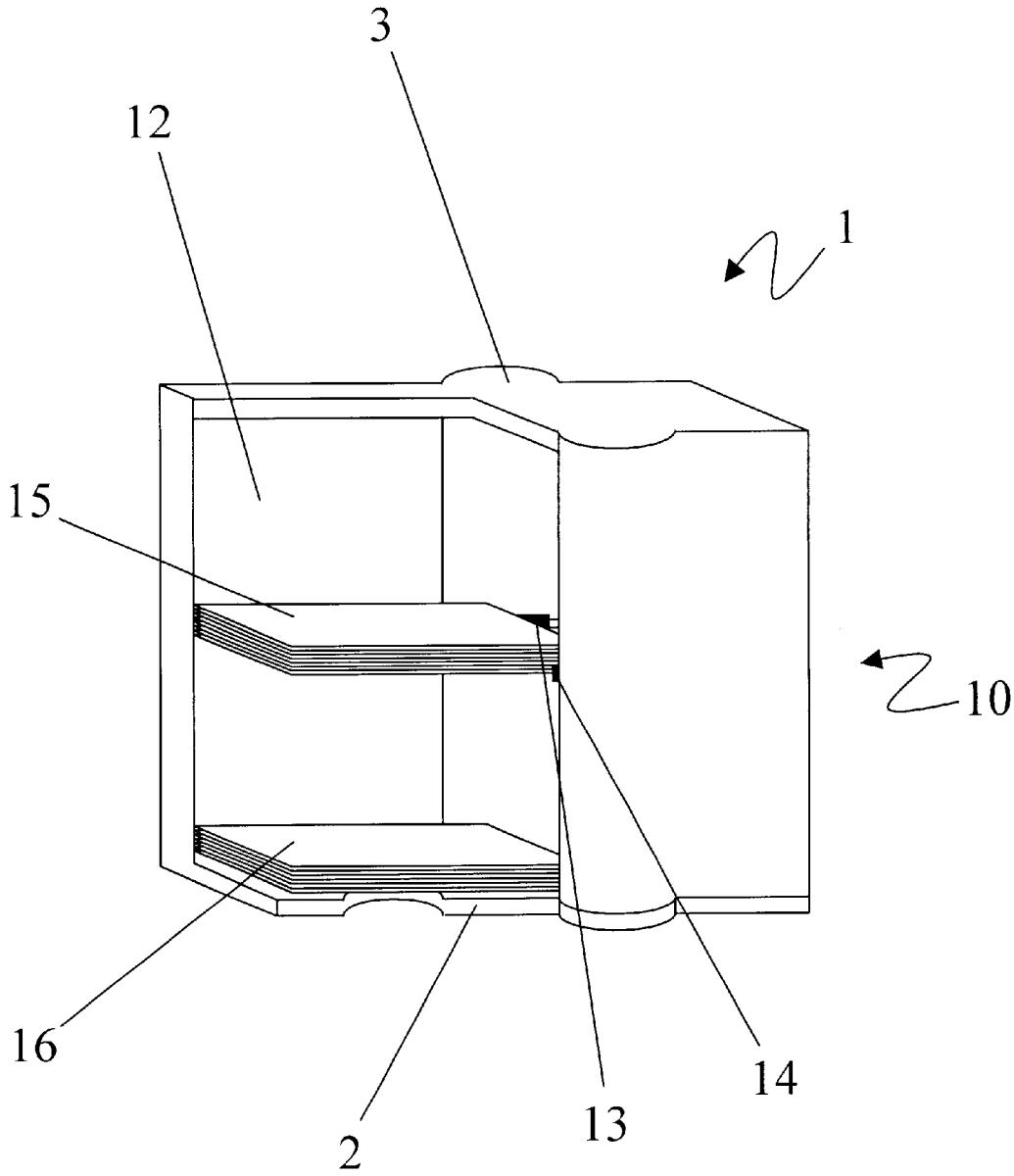
FIG. 3 presents an example of mixing of cards in the rack of FIG. 1, following random grasping and pickup of a portion of a stack of cards, in accordance with an embodiment of the present invention.

FIG. 3 shows an example of mixing of cards in the rack of FIG. 1, following random grasping and pickup of a portion of a stack of cards, in accordance with an embodiment of the present invention. As shown in FIG. 3, the clamping portion 13, 14, such as or including gripper arms, the gripper arms including, for example, rubber or other clamp ends, randomly grasps for a portion of the cards 15 of the stack of cards 15, 16 in the rack 1, and picks up the portion of the cards 15. The clamping portion 13, 14, remains in the position shown in FIG. 3 (or at another preset stop location above the portion of the cards 14 on the bottom 2) until the next cards for mixing are placed on top of the portion of the cards 14 on the bottom 2 of the rack 1. The clamping portion 13, 14, then releases the portion of the cards 15, adding these cards 15 to the portion of the cards 16 on the bottom 2 of the rack 1, including any newly added cards (e.g., cards newly discarded between the clamped card portion 15 and the portion of the cards 16 on the bottom 2). The clamping portion 13, 14 is designed with materials and so adjusted so as to ensure no marks, bends, or other impacts occur on the cards, which players could use to their advantage.

The process then repeats, with the clamping portion 13, 14 randomly moving to pick up another portion of the cards, to enhance mixing. In an embodiment of the present invention, the action of the clamping portion 13, 14 is triggered by a sensor, such as an electric or electronic eye, which senses placement of cards in the rack 1. A controller, such as a processor and/or electronic circuitry, controls motion of the clamping portion 13, 14, including any preset delay.

Figure 4:
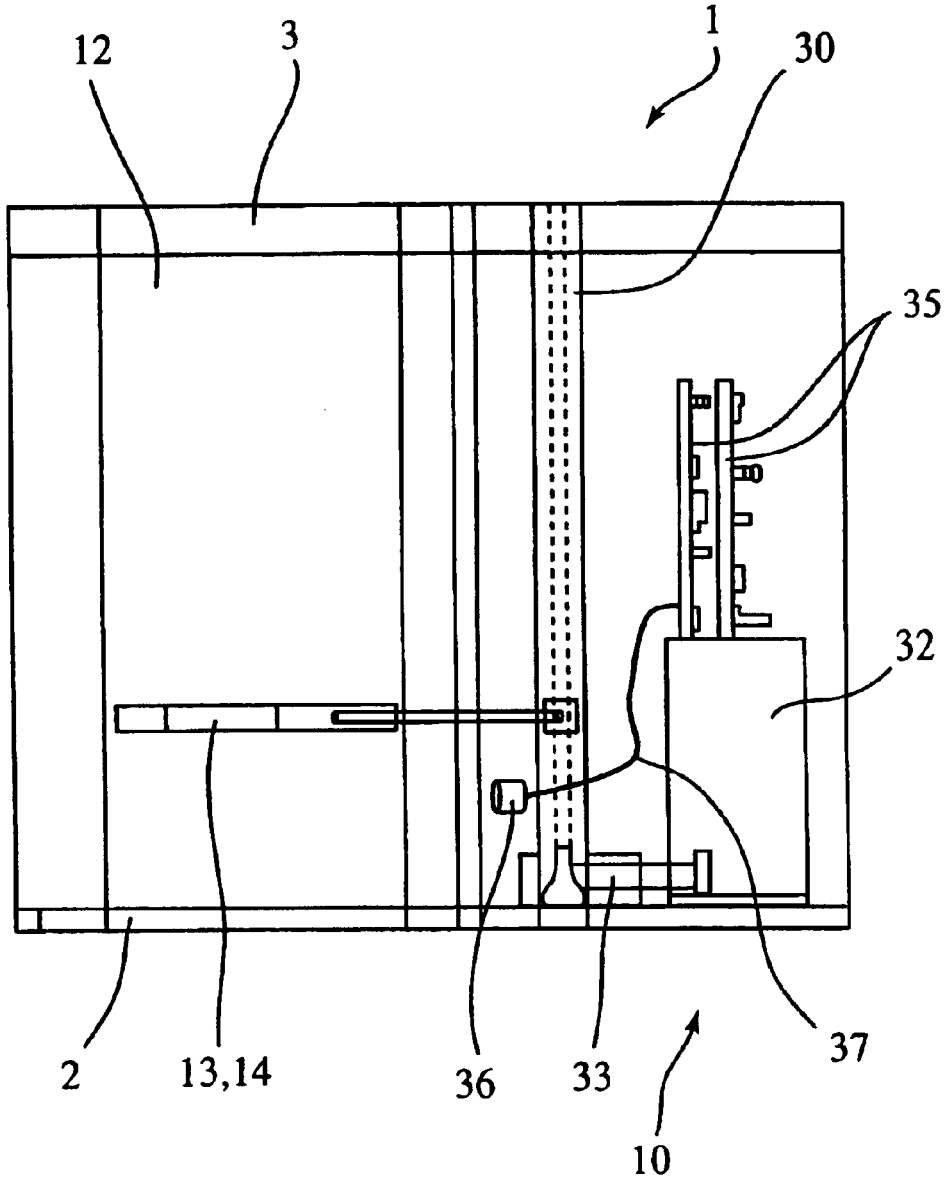
FIG. 4 is a side view of an automatic discard holder device, in accordance with an embodiment of the present invention.

FIG. 4 is a side view of an automatic discard holder device, in accordance with one embodiment of the present invention. As shown in FIG. 4, the rack 1 includes bottom 2, top, 3, at least one side portion 12, and housed portion 10. In this embodiment, inside the housed portion 10 are a moveable lifting portion 30, such as or including a ratchet mechanism, for incrementally or smoothly raising and lowering the clamping portion 13, 14. Opening and closing of the clamping portion 13, 14 is also controlled via the moveable lifting portion 30.

A moving engine 32, such as an electric motor and/or solenoid, coupled 33 to the moveable lifting portion 30, causes motion of the clamping portion 13, 14, both upwardly and downwardly, as shown in FIG. 4, along the moveable lifting portion 30, and to open and close the clamping portion 13, 14 for grasping and releasing cards. A controller 35, such as or including a processor and/or electronics, controls the operation of the moving engine 32, thereby controlling movement of the clamping portion 13, 14 via the moveable lifting portion 30, in both the upward and downward directions, as shown in FIG. 4, and to open and close the clamping portion 13, 14. A sensor 36, such as an electric eye or other mechanism for sensing that cards are placed in the device 1, is connected by coupling 37, such as by a wire or wires, to the controller 35.

In operation, the clamping portion 13, 14 is initially in a stop position, such as a position toward the top of the device 1, as shown in FIG. 4, and the clamping portion 13, 14 is closed so as to hold any cards grasped by the clamping portion 13, 14. Cards, such as discarded cards, are placed onto the bottom 2 or onto cards already placed on the bottom 2 of the device 1. The controller 35, upon sensing, by the sensor 36 via the coupling 37, that cards have been placed in the device 1, begins a cycle of operation. First, a preset delay occurs, so as to allow the newly placed cards in the device 1 to be removed, if, for example, a challenge or error occurs during course of play of the card game. The controller 35 then causes the clamping portion 13, 14 to drop or place any cards that are in the clamping portion 13, 14 onto the cards on the bottom 2.

A randomizer in the controller 35 then determines a random location for the clamping portion 13, 14 to move relative to the cards in the device 1, the random location being a random height above the bottom 2 of the device 1. This randomly determined height corresponds to a random number of cards in the pile. The controller 35 then causes the clamping portion 13, 14, to grasp and pick up any cards at or above the random location and move those cards to the predetermined stop location. This cycle is complete and the device appears as shown in FIG. 3, with, for example, a portion of the cards 15 in the clamping portion 13, 14 and a portion of the cards 16 on the bottom 2. (Note that, if the clamping portion 13, 14 moves randomly to a location above the top of the pile of cards on the bottom 2, the clamping portion 13, 14 will grasp no cards before moving to the stop location; this scenario is a random event within the scope of the present invention.) The device 1 also includes an optional release button coupled to the controller 35 for causing the release of cards from the clamping portion 13, 14 without further movement of the clamping portion 13, 14, as occurs, for example, when all cards are to be removed for shuffling and play of a card game.

The device 1 of the present invention includes a power supply or coupling for connection to a power supply, such as a wire coupling and plug for connection to a 110 or 230 volt alternating current (AC) or other outlet. The power supply may also be self-contained, such as a battery within the device 1. The present invention also includes an optional "kill switch" or other cutoff switch coupled to the controller 35 or to the power supply to interrupt power to the device in emergency situations.

Figure 5:
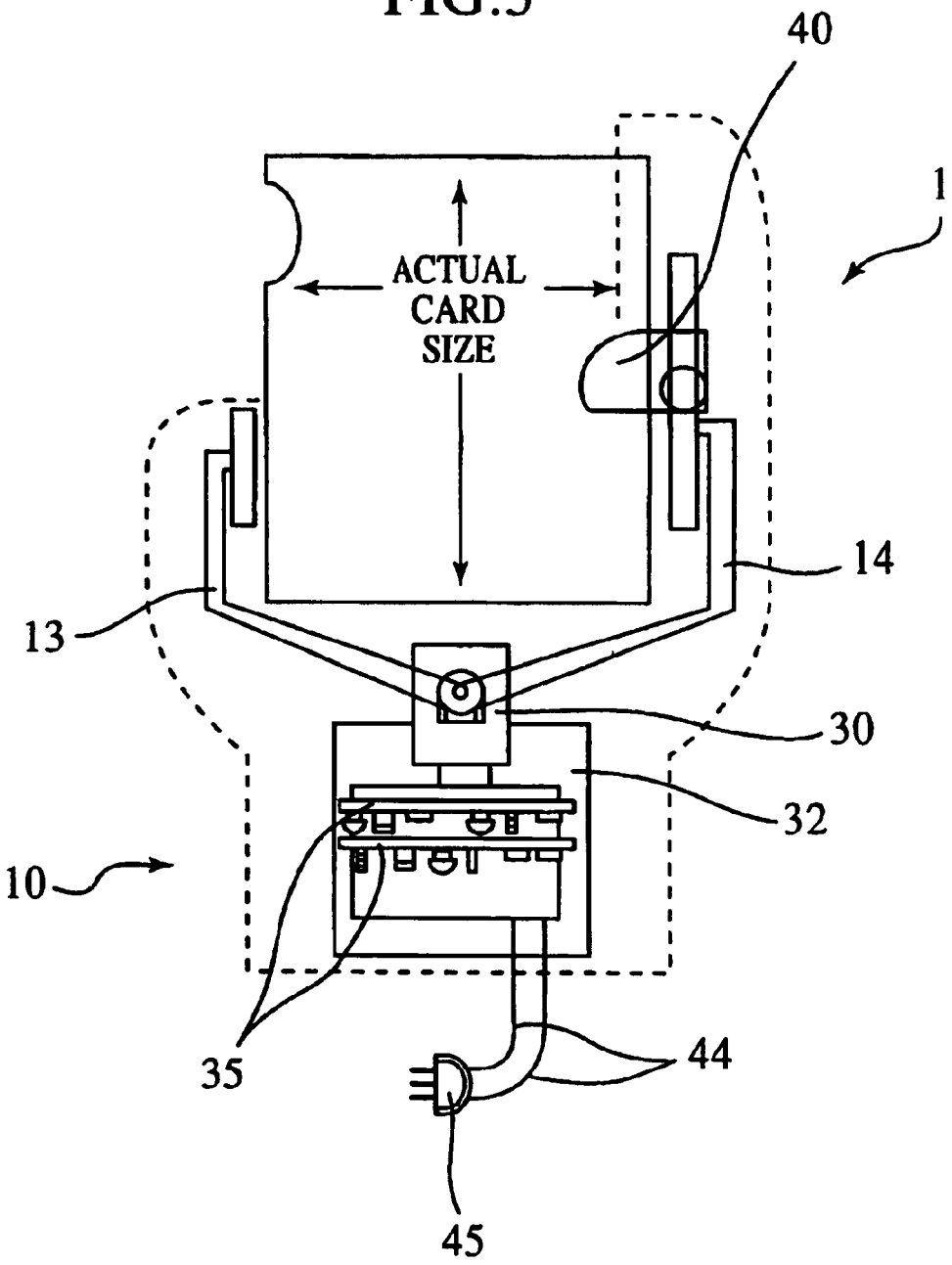
FIG. 5 is an overhead view of another embodiment of an automatic discard holder device in accordance with the present invention.

FIG. 5 is an overhead view of another embodiment of the automatic discard holder device of the present invention. In the variation of FIG. 5, the clamping portion 13, 14 includes a knife portion 40 for insertion into the stacked cards during pickup. The moveable lifting portion 30, as shown in FIG. 5, includes gears, levers, ratcheting features, and attachments to the clamping portion 13, 14 and the engine portion 32, as are known in the art, so as to allow the sequential combinations of motions to grasp, move, and release portions of the cards, in accordance with embodiments of the present invention.

Also shown in FIG. 5 is an example connection 44, such as wired connection, to the controller 35, and coupling 45, such as plug for plugging the device 1 into a power supply, such as a 110 or 230 volt AC wall outlet.

Thus, while there have been shown, described, and pointed out fundamental novel features of the invention as applied to embodiments thereof, it will be understood that various omissions, substitutions, and changes in the form and the details of the disclosed invention may be made by those skilled in the art without departing from the spirit of the invention.

What is claimed is:

1. An automatic card mixing device, comprising:

a base;

a moving engine attached to the base;

a movable lifting portion coupled to the moving engine, the movable lifting portion being movable among a plurality of random locations and a stop location;

a clamping device attached to the movable lifting portion;

a sensor for sensing the placement of at least one card on the base; and a controller for controlling the movable lifting portion and the clamping device;

wherein, upon the sensor sensing the placement of at least one card on the base, the controller causes the movable lifting portion to move to one from the plurality of random locations, the clamping device to clamp, and the movable lifting portion to move to the stop location.

2. The device of claim 1, further comprising at least one side attached to the base, wherein the base with the attached at least one side has an opening for receiving the at least one card for placement on the base.

3. The device of claim 1, wherein the controller includes a randomizer.

4. The device of claim 1, wherein the clamping portion comprises a pair of arms.

5. The device of claim 4, wherein each of the pair of arms includes a clamp end.

6. The device of claim 5, wherein the clamp end comprises rubber.

7. The device of claim 4, further comprising:

a knife portion attached to at least one of the pair of arms.

8. The device of claim 1, wherein the moving engine and the controller are attached to a power supply.

9. The device of claim 8, wherein the moving engine and the processor are attached to the power supply via a coupling.

10. The device of claim 9, wherein the coupling is an alternating current (AC) power connector.

11. The device of claim 1, further comprising a housing for enclosing the moving engine and the controller.

12. The device of claim 1, wherein the sensor comprises an electric eye.

13. The device of claim 2, further comprising a cover attached to the at least one side.

14. The device of claim 1, wherein the movable lifting portion comprises a ratcheting mechanism.

15. The device of claim 1, wherein a delay occurs prior to the processor causing the movable lifting portion to move to a random location.

16. The device of claim 15, wherein the delay is about five seconds.

17. The device of claim 1, wherein the moving engine comprises an electric motor.

18. The device of claim 1, wherein the controller comprises a processor.

19. An automatic card mixing device, comprising:

a base;

a motor attached to the base;

a movable lifting portion attached to the base, the movable lifting portion being movable among a plurality of random locations and a stop location;

a clamping device attached to the movable lifting portion;

a sensor for sensing the placement of at least one card on the base; and a processor for controlling the movable lifting portion and the clamping device;

wherein, upon the sensor sensing the placement of at least one card on the base, the processor causes the movable lifting portion to move to a random location, the clamping device to clamp, and the movable lifting portion to move to the stop location.

20. A method of automatically mixing a plurality of cards, the method comprising:

placing at least one of the plurality of cards in a card mixing device, such that a pile of cards is placed in the mixing device on a base portion of the card mixing device, the pile of cards including the plurality of cards;

randomly determining a height above the base portion;

a grasper within the card mixing device moving from a predetermined location relative to the base portion to the randomly determined height;

the grasper grasping for the plurality of cards at the randomly determined height; and the grasper returning to the predetermined location.

* * * * *